US005622403A

United States Patent [19]

Gonda

[11] Patent Number: 5,622,403

[45] Date of Patent: Apr. 22, 1997

[54] MULTI-FUNCTION CANOE CHAIR

[76] Inventor: Raymond M. Gonda, 10 Cardinal Woods, South Burlington, Vt. 05403

[21] Appl. No.: 477,992

[22] Filed: Jun. 7, 1995

[51] Int. Cl.[6] ..... A47C 9/00

[52] U.S. Cl. ..... 297/19; 114/363; 297/25; 297/423.46

[58] Field of Search ..... 297/19, 22, 25, 297/54, 423.46; 114/363

[56] References Cited

U.S. PATENT DOCUMENTS

| | | | |
|---|---|---|---|
| 1,685,599 | 9/1928 | Fletcher | 297/25 |
| 1,987,851 | 1/1935 | Holman | 297/19 |
| 1,989,146 | 1/1935 | Ogden Jr. | 297/22 |
| 4,030,487 | 6/1977 | McEachian | 601/15 |
| 4,070,058 | 1/1978 | Muehling | 297/374 |
| 4,722,570 | 2/1988 | Bertoli | 297/345 |
| 5,209,178 | 5/1993 | Rowe | 114/363 |
| 5,382,081 | 1/1995 | Henry | 297/440 |

*Primary Examiner*—Peter R. Brown
*Attorney, Agent, or Firm*—Hayes, Soloway, Hennessey, Grossman & Hage, P.C.

[57] ABSTRACT

A multi-function/positioned chair for a watercraft which can be adjusted as between sitting, kneeling, and portaging positions, comprising a seat which contains a front, rear, top and bottom sections, a structure for supporting the canoe on the front section of said seat when portaging, including a first pivot attached at said front section at the bottom of the seat and proximate to said portage support, an adjustment arm attached to said first pivot, a second pivot attached to the rear section of the seat, a first leg affixed to said seat at said second pivot and extending downwardly and under the front section of said seat, a second leg attached to said second pivot extending downwardly and under the seat under the rear section of said seat, and a member for connecting said first and second legs to maintain said legs apart under a load, characterized in that the first and second pivots are selectively disposed relative to one another, and the lengths of the first and second leg are adjusted such that the chair can be positioned as between a sitting, kneeling or portaging position.

6 Claims, 4 Drawing Sheets

MULTI-FUNCTION CANOE CHAIR

BACKGROUND OF THE INVENTION

The present invention relates to a canoe chair or seat that is generally flat-folding, portable, adjustable, ergonomically designed, multi-position, and multi-function which adapts to the sitting and kneeling positions, and which can be adjusted for use as a portage yoke.

Prior to the advent of the popularity of canoeing, which has soared in the past several decades, the types of canoe seats available were limited to the traditional "straight board" or planar type arrangement wherein a generally straight flat surface is supported at appropriate positions in the canoe, that being the bow, the stern and/or amidships. It was typically supported from gunwale level, by attachment at the underside of the gunwale. The seat was often made more comfortable by the use of a woven material such as polyester, organic fiber weaves, or padded with closed cell waterproof foam. More frequently seen, particularly in long distance traveling canoes were seats containing a bucket contour for receiving the buttocks of the paddler. This arrangement is reputed to be more comfortable on long trips than a straight board arrangement.

Some of these seats were adjustable to positions from fore-to-aft of the amidships position, for trimming the canoe during use, as desired. This is usually accomplished by fitting the planar seat into a sliding mount arrangement such that it can be positioned farther toward the bow or farther toward the stern of the craft for improved trim. In one case it is also adjustable to port and to starboard for 360 degrees of trimming capability. Such seats are not otherwise adjustable.

Most seats are limited in that, after the time of initial installation, they are not adjustable for alternating between the sitting or kneeling positions, or they do not incorporate any other function such as serving as a yoke for portaging the craft or carrying it between the motorized transportation vehicles and the water. Several exceptions with limitations exists. For example, one arrangement has placed amidships a planar seat having an indent which services as a portage yoke. Another arrangement, e.g. saddles as canoe seats, tend to be ergonomically designed for a single paddling position and are useful for specialized use in whitewater, but are not practical for all-around canoeing use and none are quickly and easily adjustable for multi-function purposes.

It is therefore an object of the present invention to overcome the disadvantages of the prior art and provide a canoe chair or seat that has a lightweight relatively flat-folding, portable, adjustable, ergonomically designed, multi-position, multi-function chair which adapts to the sitting and kneeling paddling positions, and which can be adjusted for use as a portage yoke.

It is also an object of the invention to provide a canoe chair in which the various positions of the seat can be changed using only one hand, while the paddler straddles the seat in a matter of seconds and which, furthermore, can be positioned and used in the bow, the stern, or anywhere between such extremes.

SUMMARY OF THE INVENTION

A multi-function/positioned chair for a watercraft which can be adjusted as between sitting, kneeling, and portaging positions, comprising a seat which contains a front, rear, top and bottom sections, a means for supporting the canoe on the front section of said seat when portaging, including a first pivot means attached at said front section at the bottom of the seat and proximate to said portage support means, and adjustment arm attached to said first pivot means, a second pivot means attached to the rear section of the seat, a first leg affixed to said seat at said second pivot means and extending downwardly and under the front section of said seat, a second leg attached to said second pivot means extending downwardly and under the seat under the rear section of said seat, characterized in that the first and second pivot means are selectively disposed relative to one another, and the lengths of the first and second leg are adjusted such that the chair can be positioned as between a sitting, kneeling or portaging position.

DETAILED DESCRIPTION OF THE INVENTION

Figure 1:
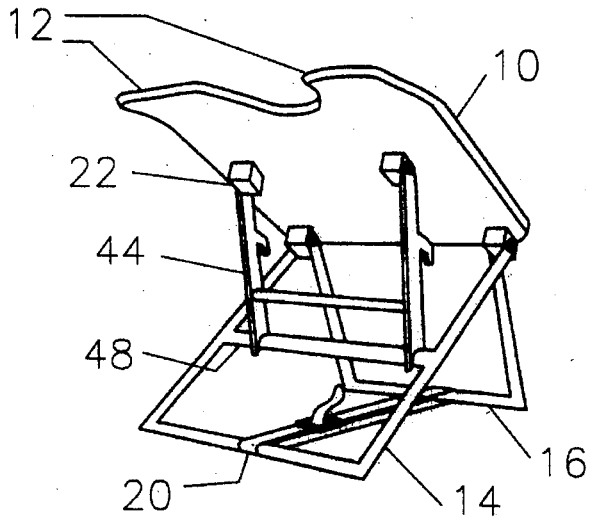
FIG. 1 is a perspective elevated view of a multi-position canoe chair/portage-yoke.
Figure 2:
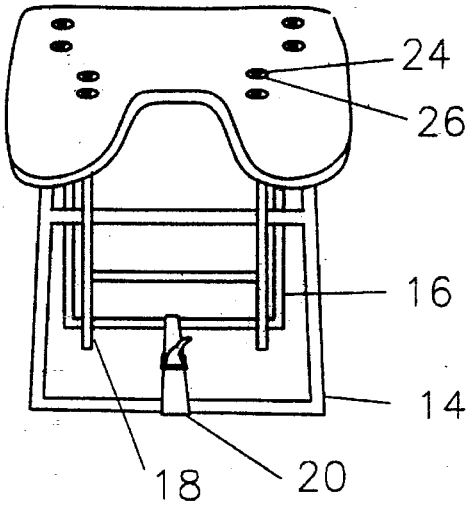
FIG. 2 is a front elevated view of the canoe seat of FIG. 1.

The present invention comprises, in one embodiment, a folding, multi-function canoe chair with a plurality of seat positions, shown in the perspective view in FIG. 1 and in the front elevated view of FIG. 2. It comprises a seat 10 with a built in portage yoke 12, a front leg 14, a rear leg 16, an adjustment arm 18, a strap 20, and a plurality of box pivot connectors 22 with associated bolts, washers and pins as a means for attaching the arm and legs to the seat. The strap maintains the proper boat floor-level spacing between the front and rear legs, keeping them from separating under the action of a load force.

Figure 5:
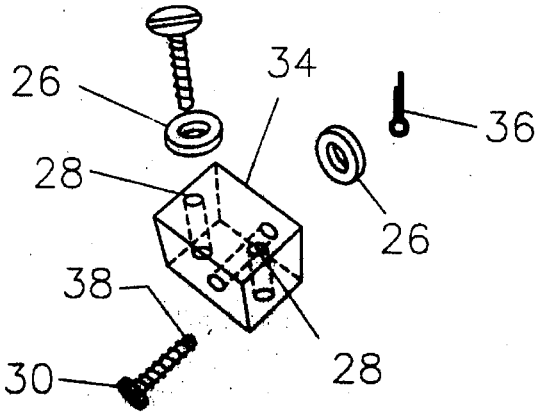
FIG. 5 is an enlarged exploded view detailing the a box pivot connector.
Figure 6:
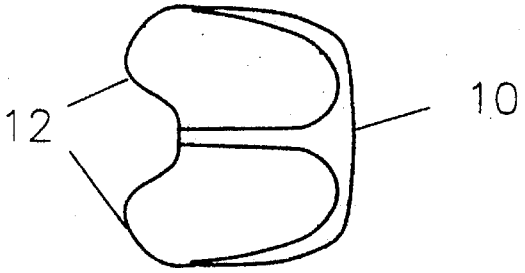
FIG. 6 is a top view of the preferred shape of the canoe seat of FIG. 1.
Figure 7:
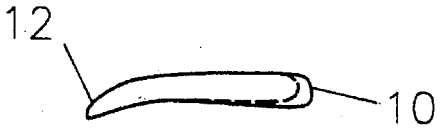
FIG. 7 is a side view of the seat shown in FIG. 6.

As seen in FIGS. 1 and 2 each of the four box connectors are secured by two carriage bolts 24 and two washers 26 to the seat 10. As seen in FIG. 5, the carriage bolts are threaded into the bore sleeves 28 after passing through a bore in the seat to effect the attachment of the seat to the box connectors.

Figure 3:
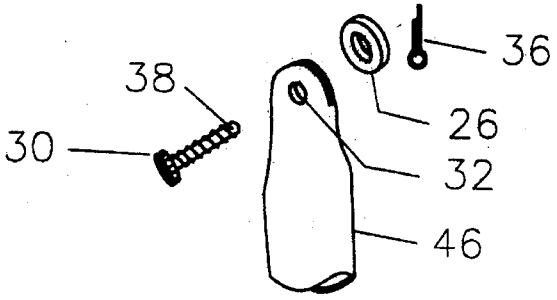
FIG. 3 is a fragmentary perspective exploded view of the seat connection extremity of the chair front and/or rear leg of FIGS. 1 and 2.
Figure 4:
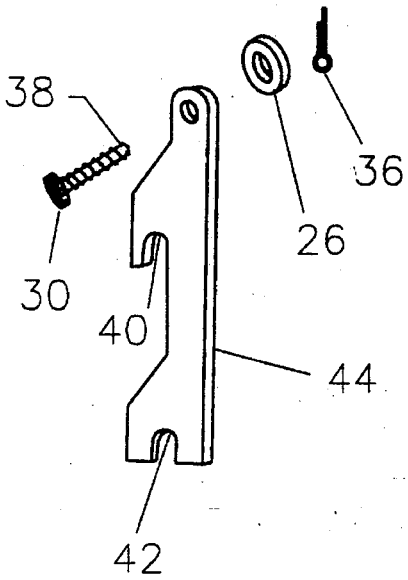
FIG. 4 is an exploded fragmentary view of the adjustment arm detailing the adjustment leg.

Looking at FIGS. 3 and 4 both the front and back legs are attached to the seat by means of a finger bolts 30, which is passed through the bore sleeve 32 of the leg, thence through the box pivot connector 34, as seen in FIG. 5, being secured by a pin 36 passed through the pin sleeve 200 of the finger bolt. The washer reduces friction when the leg is allowed to pivot relative to the box connector.

Figure 8:
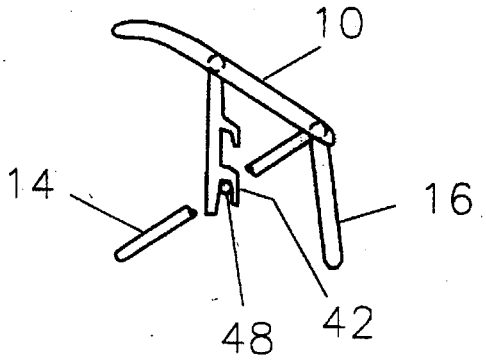
FIG. 8 is a fragmentary elevated side view of the portage configuration of the canoe chair of FIG. 1.
Figure 9:
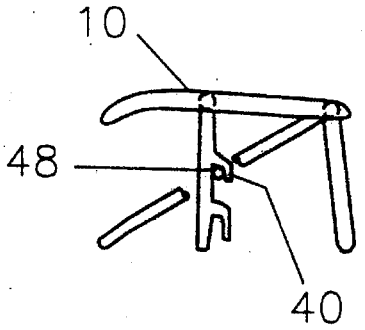
FIG. 9 is a fragmentary elevated side view of the sitting configuration of the canoe chair of FIG. 1.
Figure 10:
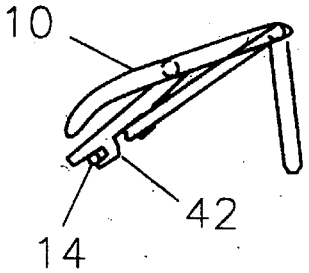
FIG. 10 is a fragmentary elevated side view of the kneeling configuration of the canoe chair of FIG. 1.
Figure 11:
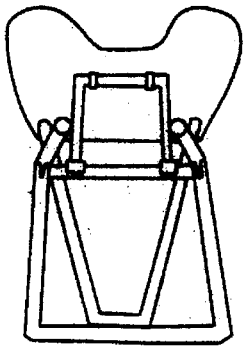
FIG. 11 is a front elevated view of alternate embodiment A of a multi-function canoe chair.

The catch positions 40 and 42 as shown in FIG. 4 on the adjustment arm legs 44 in combination with the horizontal section of the front leg 46 and the cross bar 48 provides the means for multi-purpose functionality by adjusting to positions for portaging, sitting, and kneeling. Looking at FIG. 8 the portage position and configuration of the adjustment arm is shown. In this configuration the arm is positioned such that the lower catch 42 engages the cross bar 48 of the arm. In FIG. 9, engagement of the upper catch 40 on the cross bar accomplishes the sitting configuration of the seat. The kneeling position configuration is accomplished by engagement of the lower catch on the horizontal part of the leg which is in contact with the floor.

The chair is preferably attached to the floor. As a method of attachment of the chair to the floor, D-rings could be attached to the floor in a hard-hulled boat and straps with fasteners or buckles attached could be run over the chair legs at the four corners and secured to the D-rings. The straps could be secured directly to the formers and/or stringers in a folding boat at floor level. If the chair is securely attached to the floor in the above manner, the strap 20 of FIG. 1 running from the front to the rear leg may not be required.

ALTERNATE EMBODIMENTS AND SCOPE

The basic embodiment described hereinabove is one alternative of the multi-functional, multi-position canoe seat of the present invention. Some alternate embodiments are described hereinbelow. All such embodiments can be made lightweight and flat-folding for convenient storage and transport, and can be adjusted quickly to various seat positions. All can be attached to the floor of the boat and all use a strap or similar means running from the front to the chair to the back of the chair nearest the water level or bottom of the boat.

Figure 21:
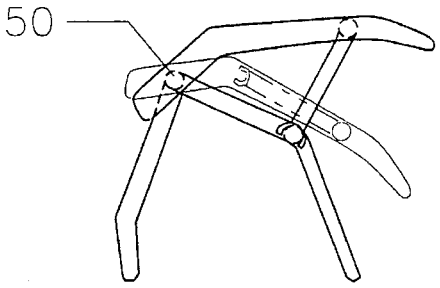
FIG. 21 is an elevated side view of alternate embodiment H of a multi-function canoe chair.
Figure 22:
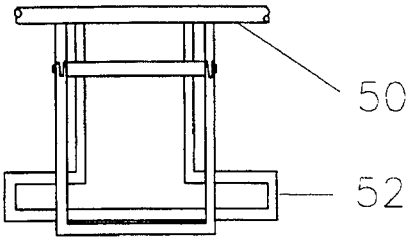
FIG. 22 is a fragmentary front view of the chair of FIG. 21 with the seat removed.
Figure 23:
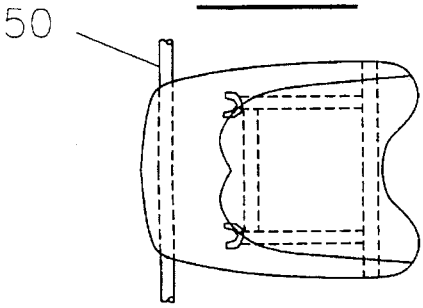
FIG. 23 is a top view of the preferred shape of the canoe seat of FIG. 21.
Figure 24:
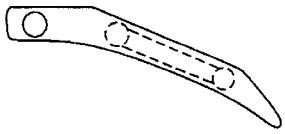
FIG. 24 is a side view of the seat shown in FIG. 23.

Those skilled in the art will recognize that the embodiments disclosed herein could be easily modified to accommodate a greater number or a fewer number of seat configurations that the ones shown. In most case this means adding or substrating cross-bars from the designs shown. A still further general modification to these designs would provide for a thwart to be passed through the chair for more solid anchorage to the boat which may also permit elimination of the rear leg of the chair. This thwart could provide a convenient pivot point for seat orientation between the carrying, sitting and kneeling positions. An illustrated example of such a use of a thwart 50 is shown in FIGS. 21, 22, and 23.

FIGS. 1 through 24 (hereinafter described as embodiments A through H) inclusively show at least alternative eight embodiments of canoe chairs which provide for the functions of portaging, sitting and kneeling. The embodiment shown in FIG. 21 provides the three functions with just two seat positions; embodiment G shown in FIG. 20 differs from all the other embodiments in that is employs a sliding device attached to the underside of the seat to which the front leg is attached and is thus continuously adjustable for seat position between the kneeling and portaging positions for more than three positions. In each of the following alternate embodiments, B through G, multiple seat positions have been consolidated onto one drawing for economy of presentation. A description of these alternate embodiments of a multi-function canoe chair follows.

Alternate Embodiment A

Figure 12:
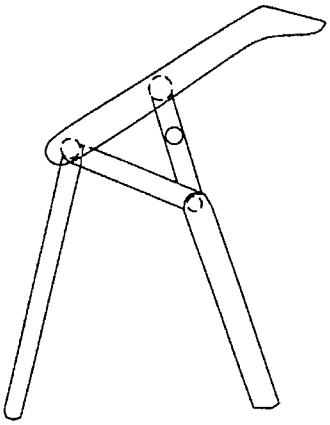
FIG. 12 is a fragmentary elevated side view of the portage configuration of the canoe chair of 11.
Figure 13:
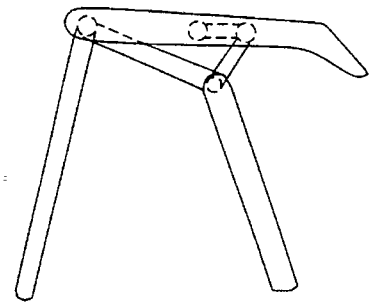
FIG. 13 is a fragmentary elevated side view of the portage configuration of the canoe chair of FIG. 11.
Figure 14:
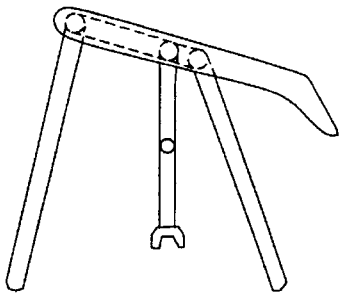
FIG. 14 is a fragmentary elevated side view of the portage configuration of the canoe chair of FIG. 11.

FIGS. 11, 12, 13 and 14 show a canoe chair wherein the adjusting arm itself folds near the center-point of its adjustment arm leg in order to effect a change of configuration from the portage position, as shown in FIG. 12, to the sitting position as shown in FIG. 13. The kneeling position is accomplished by allowing the adjustment arm to hang free from its base-connection to the seat as seen in FIG. 14. The front leg also folds near at the position of its crossbar.

Alternate Embodiment B

Figure 15:
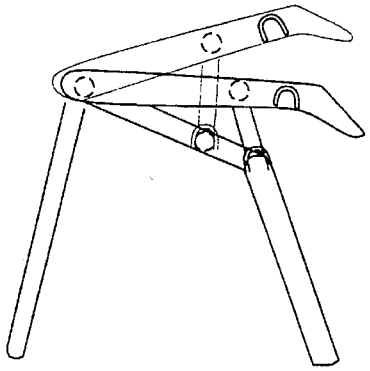
FIG. 15 is an elevated side view of alternate embodiment B of a multi-function canoe chair.

FIG. 15 shows a canoe chair which parallels the architecture of alternate embodiment A, except that its adjustments arm is not jointed near its center. The adjustment arm is connected at its base to the underside of the seat and utilized two cross-bars on the front leg to effect the portage and sitting positions but which hangs free to effect the kneeling position. An alternate catch, attached to the underside of the seat, effects securing of the seat into the kneeling position. The front leg of this embodiment folds at the cross-bar.

Alternate Embodiment C

Figure 16:
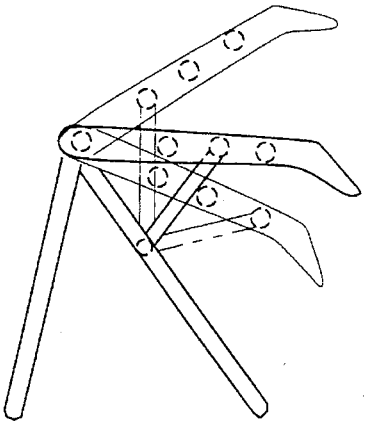
FIG. 16 is an elevated side view of alternate embodiment C of a multi-function canoe chair.

FIG. 16 shows a canoe chair in which the base-connection of the adjustment arm is on a cross-bar of the front leg. The various positions of the seat are accomplished by adjusting the position of the upper or seat end, of the adjustment arm, the different positions on the underside of the seat, and by snapping it into a secure position there.

Alternate Embodiment D

Figure 17:
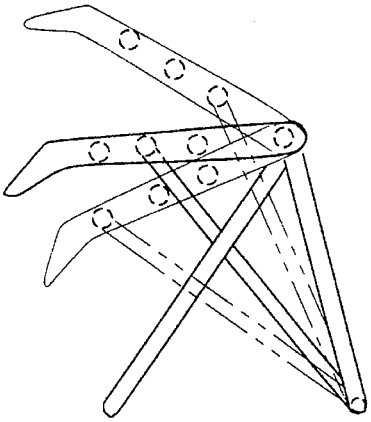
FIG. 17 is an elevated side view of alternate embodiment D of a multi-function canoe chair.

FIG. 17 shows a canoe chair in which the base-connection of the adjustment arm is on the horizontal portion of the rear leg nearest the floor of the boat. The various positions of the seat on the chair are accomplished by varying the position of the seat-end or upper end of the adjustment arm to different positions on the underside of the seat and securing it thereto.

Alternate Embodiment E

Figure 18:
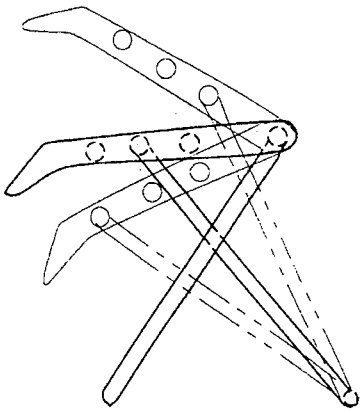
FIG. 18 is an elevated side view of alternate embodiment E of a multi-function canoe chair.

FIG. 18 shows a canoe chair in which the rear leg also functions as the adjusting arm. The adjusting arm engages the bottom side of the seat as in embodiment D described hereinabove.

Alternate Embodiment F

Figure 19:
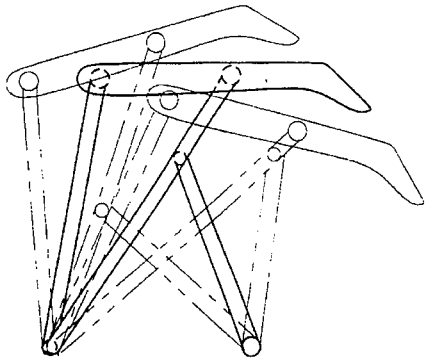
FIG. 19 is an elevated side view of alternate embodiment F of a multi-function canoe chair.

FIG. 19 shows a canoe seat in which the adjustment arm is a separate piece, which is not attached to the rest of the chair, except at the variable point of engagement for seat positioning. It serves as the adjustment arm. The front and rear legs are affixed to the bottom of the seat and to each other at floor level and are fixed, in position, to each other and to the seat. The seat, along with the front and rear legs, pivots as a unit to the various functional positions. The adjustment arm accomplishes the various functional positions by pivoting on its lower extremity at floor level and engaging separate cross-bars affixed to the front leg.

Alternate Embodiment G

Figure 20:
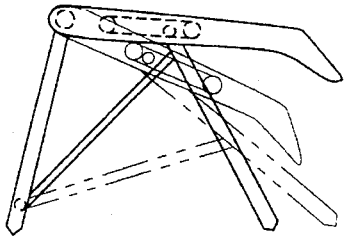
FIG. 20 if an elevated side view of alternate embodiment G of a multi-function canoe chair.

FIG. 20 shows a canoe chair which differs fundamentally from all the other embodiments listed in that is employs a sliding adjustment mechanism, a pivot, a strap to accomplish the various seat positions, and is continuously adjustable. The sliding mechanism is rigidly attached to the underside of the seat. The cross-bar at the juncture of the adjustment arm and the front leg serves as pivot for accommodating the changing orientations of the adjustment arm and the front leg. The various functional positions of the seat are accomplished by the combined actions this pivot in harmony with the sliding mechanism of the seat. A strap running from the front leg to the back leg is loosened to accommodate the changing positions of the seat then is again fastened at the desired seat positions for final engagement.

Alternate Embodiment H

FIG. 21 shows a two position canoe chair wherein the sitting position is accomplished while the seat is adjusted to the kneeling position. To sit on it the paddler slides to the rear of the seat and sits on the back of it. As can be seen from FIGS. 23 and 24 the seat is shaped to facilitate both the sitting and kneeling functions. The adjusted position of the seat serves as the portage configuration. The chair has a thwart running through the pivot point of the seat. The opposite ends of the thwart would be rigidly affixed to the sides of the boat. Just above floor level on the lower portions of the rear leg is a toe-brace 52 for the paddler's feet. The chair could be made to be used with a thwart or without a thwart as a stand-alone chair, in a convertible fashion, at the option of the boat owner.

Various other advantages and modifications of the above described embodiments will be apparent to those skilled in the art and may be made without the parting of spirit and scope to the attached claims.

I claim:

1. A multi-function/positioned chair for a watercraft which can be adjusted as between sitting, kneeling and portaging positions, comprising a seat which contains a front, rear, top and bottom sections;

a portaging support means on the front section of said seat for supporting the seat when used as a portage yoke; and a supporting framework pivotally connected to said seat, said supporting framework comprising a first and second leg member pivotally attached at the rear of said seat, characterized in that said first and second leg members are substantially disposed in use in the form of an inverted V, and a third leg member also pivotally attached to said seat, characterized in that said third leg member contains means for engaging with said second leg member to support said seat for sitting, kneeling and portaging, and wherein the portaging support means on the front section of said seat for supporting the seat comprises a cut-out section of sufficient size for portaging said watercraft.

2. The multi-function/positioned canoe chair of claim 1 further including connecting means attached between said first and second leg members for maintaining the spacing as between said first and second legs.

3. The multi function/positioned canoe chair of claim 2 where said connecting means is a strap.

4. The multi function/positioned canoe chair of claim 1 wherein said third leg member pivotally attached to said seat is first attached to an adjusting arm which is then connected to said seat and which adjusting arm folds at its center point.

5. The multi function/positioned canoe chair of claim 1, wherein said third leg member pivotally attached to said seat is first attached to an adjusting arm which is then connected to said seat, said adjusting arm providing a means to position said seat in a sitting position and which adjustment arm hangs free when said seat is positioned in a kneeling position, said seat further containing a separate means for securing said seat in a kneeling position.

6. The multi function/positioned canoe chair of claim 1 wherein said third leg member pivotally attached to said seat is attached at the front side of said seat.

* * * * *